US005836138A

United States Patent [19]

Hendriks

[11] Patent Number: 5,836,138

[45] Date of Patent: Nov. 17, 1998

[54] APPARATUS FOR ASSEMBLING AND PACKAGING MAIL ITEMS

[75] Inventor: Johan Hendriks, Hoorn, Netherlands

[73] Assignee: Buhrs Zaanhdam B.V., Zaandam, Netherlands

[21] Appl. No.: 852,451

[22] Filed: May 6, 1997

[30] Foreign Application Priority Data

May 6, 1996 [NL] Netherlands ..... 1003045

[51] Int. Cl.[6] ..... B65B 11/20; B65B 35/24

[52] U.S. Cl. ..... 53/206; 53/55; 53/550; 53/569

[58] Field of Search ..... 53/206, 460, 569, 53/284.3, 55, 550, 450, 154

[56] References Cited

U.S. PATENT DOCUMENTS

| | | | |
|---|---|---|---|
| 2,736,999 | 3/1956 | Rouan et al. | 53/569 X |
| 4,169,341 | 10/1979 | Roetter et al. | 53/569 X |
| 4,972,655 | 11/1990 | Ogawa | 53/569 X |
| 5,251,425 | 10/1993 | Kern | 53/569 X |

*Primary Examiner*—James F. Coan
*Attorney, Agent, or Firm*—Griffin, Butler, Whisenhunt & Szipl, LLP

[57] ABSTRACT

An apparatus for assembling and packaging mail items, comprising a transport track which includes an endless conveyor with mail item forwarding projections and a conveyor drive, as well as at least one feeding device with a feeding device drive, which feeding device is arranged above and in-line with the transport track for the purpose of feeding documents, such as for instance supplements, the feeding device comprising a feeding device delivery gap located some distance above a transport surface formed by the transport track, characterized by a document guiding device arranged downstream of the feeding device delivery gap, which document guiding device comprises a first endless conveyor and a second endless conveyor each having a portion of a transport part in mutual abutment and thus forming a document guiding path bounded by a document guiding path infeed gap and a document guiding path delivery gap, with a drive of the first and the second endless conveyor being independent of the feeding device drive, and in operation the transport speeds of the first and the second conveyor are equal to each other.

7 Claims, 3 Drawing Sheets

APPARATUS FOR ASSEMBLING AND PACKAGING MAIL ITEMS

This invention relates to an apparatus according to the preamble of claim 1.

Such an apparatus is known from practice and is marketed by applicant, among others. The apparatus is used, for instance, for packaging magazines or the like, to which loose documents may have been annexed. In this connection, the term document must be interpreted broadly: it may be understood to include any product that is foldable, such as, for instance, a loose sheet of paper, a brochure or a magazine. Such assembled mail items are formed in a mail item assembly path. In the mail item assembly path, a main document is forwarded over a transport track by means of mail item forwarding projections which are attached to an endless conveyor at a certain mutual distance. Next to or above the transport track, at least one feeding device is arranged, by means of which a supplementary document can be added to the main document for the purpose of assembling the mail item. The supplementary documents are delivered by the feeding device at a point adjacent a feeding device delivery gap.

The present invention specifically relates to an apparatus where the feeding device is arranged above and in-line with the transport track.

A drawback of the known apparatus is that the feeding device delivery gap is located some distance above the transport surface of the transport track. In particular at higher speeds, a certain air flow arises above the transport track. As a result of this air flow, the documents delivered by the feeding device may float above the transport track and not be accurately positioned in front of the mail item forwarding projection referred to. Thus the supplementary document may end up, for instance, with one half of it disposed on a mail item forwarding projection, which can lead to disturbance of the subsequent handling process, such as, for instance, the packaging process or the feeding of a second additional document.

Another drawback of the known apparatus is that the feeding speed of the feeding device sometimes differs considerably from the transport speed of the main product. The transport speed of the feeding device is, for instance, about 635 mm per cycle time, while the transport speed of the conveyor of the transport track can vary from about 200 mm to 800 mm per cycle time. By 'cycle time' is meant a period of time necessary to advance the conveyor one pitch distance between the mail item forwarding projections or the time necessary for the feeding device to traverse one feeding cycle. The term cycle time can therefore be used both with an apparatus with continuous and with intermittent mail item transport. The cycle time of the feeding device is always selected to be equal to the cycle time of the conveyor of the transport track. A document delivered by a feeding device can therefore have a speed differing considerably from the mail item on the transport track, which is also not beneficial to the accuracy of the positioning of the document to be added.

The object of the invention is to provide an apparatus of the type mentioned in the preamble, without the above-indicated drawbacks.

To that end, the apparatus is characterized, according to the invention, by the features of claim 1.

Through the presence of the document guiding path, the document to be delivered can be released closer to the transport surface, so that the chance of the document starting to float as a result of the air flow above the transport surface is minimized. Owing to the drive of the first and the second endless conveyor being independent of the feeding device drive, the feeding speed of the document to be added to the mail item can be controlled by the document guiding device and be adjusted to the transport speed of the conveyor of the transport track. The document to be added is not only released closer to the transport surface but also has precisely the speed matching the transport speed of the conveyor of the transport track. This minimizes the chance that the document to be added is wrongly positioned on the transport track and disturbs the further handling process.

According to a further elaboration of the invention, the invention is characterized by the features of claim 2.

Owing to the drive of the first and the second endless conveyor being coupled to the drive of the endless conveyor of the transport track, the speeds of these conveyors can be kept equal in a simple manner. This coupling can be effected both electrically and mechanically.

In order to be able to set the distance of the document guiding path delivery gap to the transport surface, the apparatus is characterized, according to a further elaboration of the invention, by the features of claim 3.

According to a still further elaboration of the invention, the apparatus is further characterized by the features of claim 4. Owing to the position of the first guide roller being adjustable, the position of the document guiding path infeed gap can be chosen freely. This position can, for instance, be chosen such that the document to be added already has its leading side running in the document guiding path before the trailing side of the document has been released from the guide means of the feeding device. What is thus accomplished is that the complete path followed by the document until the downstream side thereof leaves the document guiding path delivery gap is followed in a controlled and actively directed manner. In other words, the document is not released anywhere, so that the air stream gets no grip on the document. Due to the adjustable position of the first guide roller, this situation can be achieved for documents of different sizes. As a consequence of the difference in speed between the transport of the feeding device and the transport of the document guiding device, the paper to some extent will be upset and bend between the feeding device delivery gap and the document guiding path infeed gap. The extent to which such bending occurs depends on the length of the document to be added and on the differences in transport speed between the feeding device and the document guiding device. In itself the upset and bending of the document to be added do not constitute a problem if sufficient space is present for that purpose. This space can also be created by the adjustable first guide roller and be adapted to the length of the document to be added and the differences in transport speed.

In order to be able to also set the direction in which the document to be added is delivered, the apparatus is further characterized by the features of claim 5.

A good accessibility for the purpose of setting the guide rollers is obtained by the features of claim 6, since in that case the conveyor provided with adjustable guide rollers is the upper conveyor.

A simple adjustability of the guide rollers is obtained when the apparatus is characterized by the features of claim 7. The levers make the positioning of the guide rollers simple.

The invention will be further explained on the basis of an exemplary embodiment represented in the drawings, in which.

Figure 1:
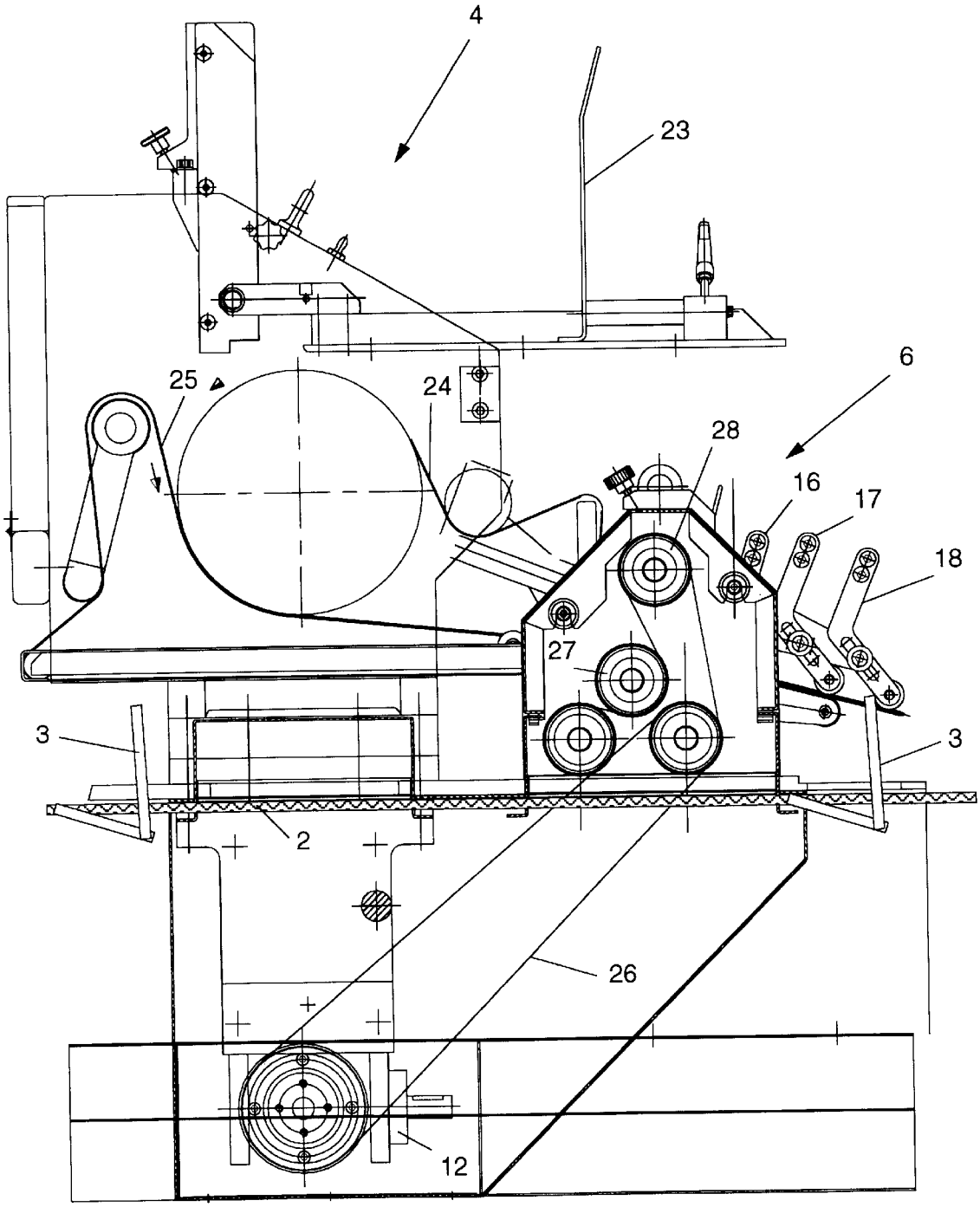
FIG. 1 is a side elevation of a part of the mail item assembly path, in which a feeding device and a document guiding device are represented.
Figure 2:
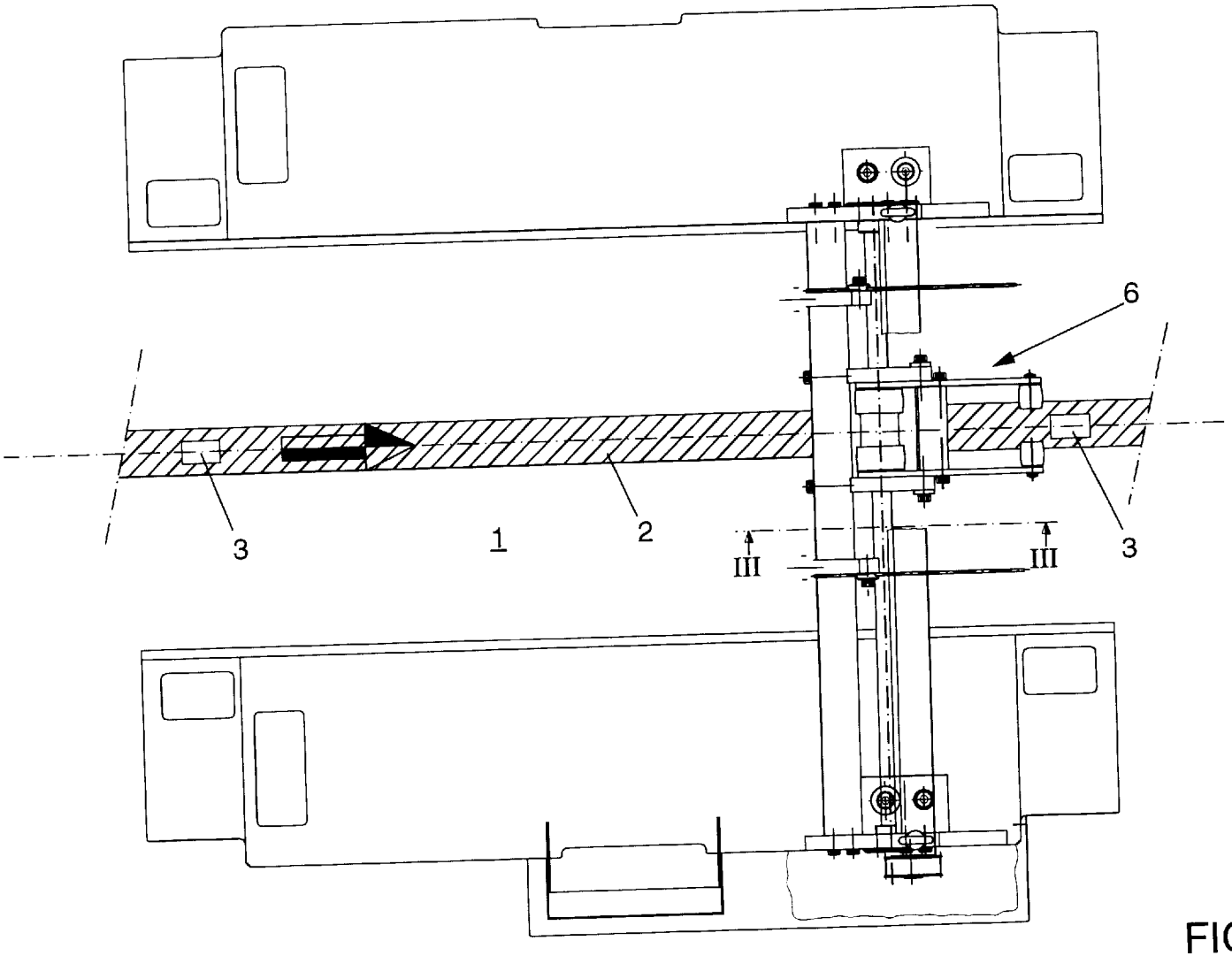
FIG. 2 is a top plan view of the transport surface and the document guiding device, with omission, for clarity, of the feeding device.

The figures show the relevant part of the mail item assembly path of an exemplary embodiment of an apparatus for assembling and packaging mail items. With such an apparatus mail items are assembled from documents in a mail item assembly path and then placed on a film or paper web in a packaging path. The film or paper web is folded around a mail item placed thereon and closed by gluing and/or sealing in order to form a mailable postal package.

The apparatus comprises, in the mail item assembly path, a transport track 1 with mail item forwarding projections 3 and a conveyor drive, not shown. The mail item assembly path includes at least one feeding device 4 with a feeding device drive, not shown. The feeding device 4 is arranged above and in-line with transport track 1 for the purpose of feeding documents, such as, for instance, inserts. The term 'document' in this connection should be given a broad interpretation. Examples would include, for instance, loose sheets, booklets, brochures, magazines and like flexible products. The feeding device 4 is provided with a document magazine 23, two feeding conveyors 24, 25 between which are clamped documents from the document magazine 23 which are to be fed, and a feeding device delivery gap 5 which is located some distance above a transport surface formed by the transport track 1. According to the invention, downstream of the feeding device delivery gap 5, a document guiding device 6 is arranged, which comprises a first endless conveyor 7 and a second endless conveyor 8, each having a portion of a transporting part in mutual abutment, thus forming a document guiding path 9. The document guiding path 9 is bounded on the infeed side by a document guiding path infeed gap 10 and on the delivery side by a document guiding path delivery gap 11. The first and the second endless conveyor 7, 8 are driven by a drive 12 which is controllable independently of the feeding device drive. In operation, the transport speeds of the first and the second conveyor 7 and 8, respectively, are equal to each other.

In the present exemplary embodiment, the drive 12 of the first and the second endless conveyor 7, 8 is coupled to the drive of the endless conveyor 2 of the transport track 1. The coupling is such that the transport speed of the first and the second endless conveyor 7, 8 of the document guiding device 6 is equal to the transport speed of the endless conveyor 2 of the transport track 1. The coupling can be effected electrically, electronically, or mechanically. The drive 12 of the document guiding device 6 is designed as an electric motor 12 which, via a belt or chain 26, drives driving wheels 27, 28, which are mounted on shafts 29, 30, of the second and the first conveyor 8, 7, respectively.

Figure 3:
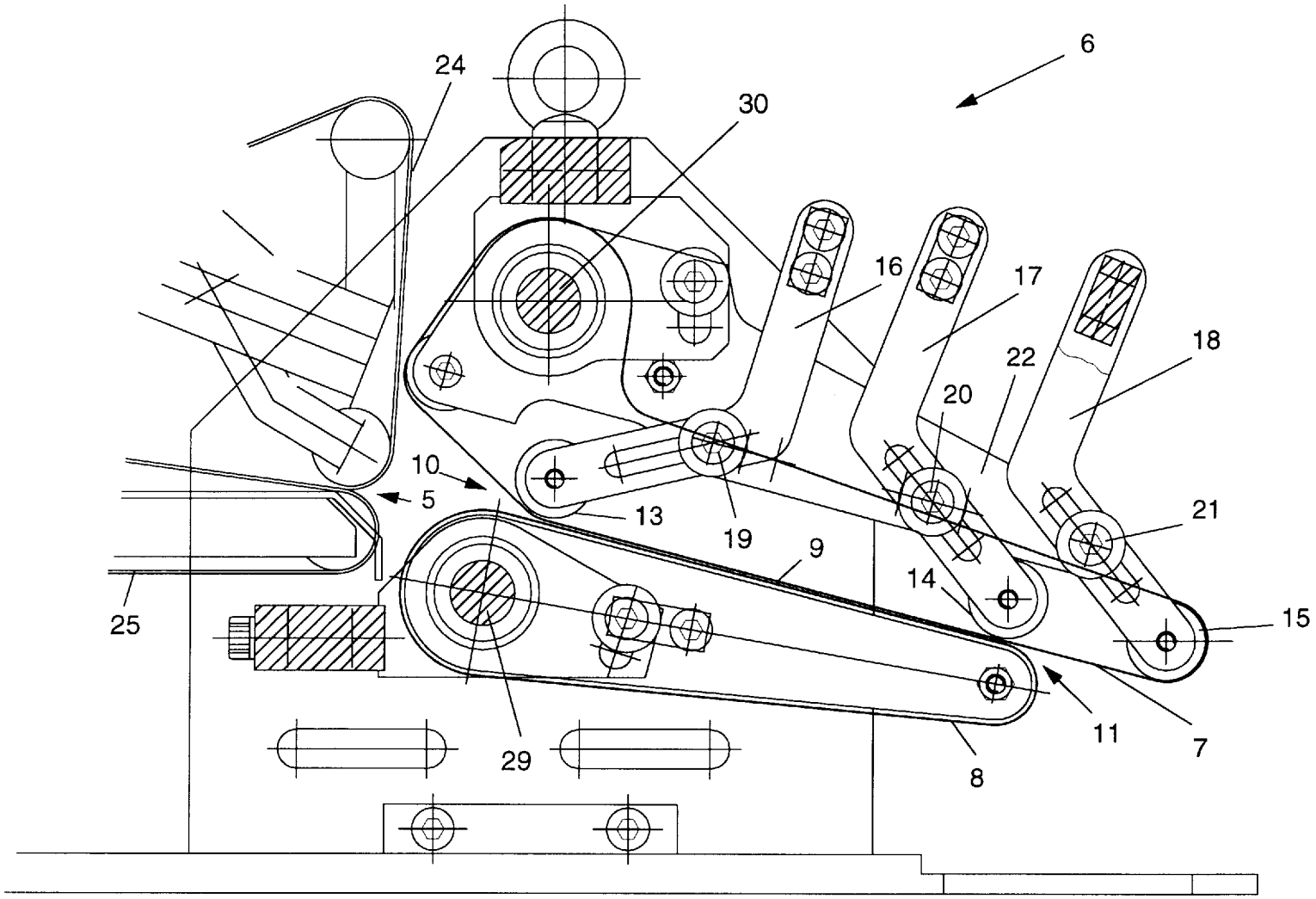
FIG. 3 is a sectional elevation along the line III—III in FIG. 2, showing a side view of the most relevant part of the document guiding device.

As is clearly shown in FIG. 3, the inclination relative to the transport surface of transport track 1, of the parts of both the first and the second conveyor 7, 8 that form the document guiding path 9, is adjustable. To that effect, the first conveyor 7 is provided with a first and a second guide roller 13 and 14, respectively, with adjustable position. The position of the first guide roller 13 is further also adjustable in such a manner that the position of the document guiding path infeed gap 10 is adjustable and can be varied.

In addition, the first conveyor 7 is provided with a third guide roller 15 with an adjustable position, which third guide roller 15 is arranged downstream of the document guiding path delivery gap 11. The direction of the document delivery is dependent on the adjusted position of the third guide roller 15. Owing to the first conveyor 7 with the adjustable guide rollers 13, 14, 15 being the upper conveyor and the second conveyor 8 being the lower conveyor, the accessibility of the guide rollers 13, 14, 15 for the purpose of adjusting them is good. Adjustment of the guide rollers 13, 14, 15 is further facilitated in that they are bearing-mounted in lever arms 16, 17, 18 provided with slotted holes 16*a*, 16*b*, 16*c*. The lever arms are attached to a fixed frame portion 22 via bolt connections 19, 20, 21 through the slotted holes 16*a*, 16*b*, 16*c*.

The ample adjusting possibilities of the guide rollers make it possible for the document to be delivered to be accurately positioned in front of a mail item forwarding projection 3 on the transport surface of transport track 1 with a speed of travel corresponding with the speed of the transport track conveyor 2. Thus the chance that the further handling process is disturbed by an improperly positioned added document is minimized.

It will be clear that the invention is not limited to the exemplary embodiment described, but that various modifications are possible within the scope of the invention.

I claim:

1. An apparatus for assembling and packaging mail items, wherein the mail items are assembled from documents in a mail item assembly path and thereafter are placed on a web in a packaging path, which web is folded around the mail item placed thereon and is closed in order to form a mailable postal package, the apparatus comprising, in the mail item assembly path, a transport track (1) which includes an endless conveyor (2) with mail item forwarding projections (3) and a conveyor drive, as well as at least one feeding device (4) with a feeding device drive, which feeding device (4) is arranged above and in-line with the transport track (1) for feeding documents, the feeding device (4) comprising a feeding device delivery gap (5) located a distance above a transport surface formed by the transport track (1), the apparatus further comprising a document guiding device (6) arranged downstream of the feeding device delivery gap (5), which document guiding device (6) comprises a first endless conveyor (7) and a second endless conveyor (8), each having a portion of a transport part in mutual abutment and thus forming a document guiding path (9) bounded by a document guiding path infeed gap (10) and a document guiding path delivery gap (11), while a drive (12) of the first and the second endless conveyor (7, 8) is independent of the feeding device drive, and in operation the transport speeds of the first and the second conveyor (7 and 8, respectively) are equal to each other.

2. An apparatus according to claim 1, wherein the drive (12) of the first and the second endless conveyor (7, 8) is coupled to the drive of the endless conveyor (2) of the transport track (1), in such a manner that the transport speed of the first and the second endless conveyor (7, 8) of the document guiding device (6) is equal to the transport speed of the endless conveyor (2) of the transport track (1).

3. An apparatus according to claim 1, wherein the inclination with respect to the transport surface of the transport track (1), of the part of both the first and the second conveyor (7, 8) forming the document guiding path (9) is adjustable.

4. An apparatus according to claim 3, wherein the first conveyor (7) comprises a first and a second guide roller (13 and 14, respectively), each with an adjustable position, with the aid of which the inclination relative to the transport surface of the transport track (1), of the part of the first conveyor (7) forming the document guiding path (9) is adjustable, the position of the first guide roller (13) further being adjustable in such a manner that the position of the document guiding path infeed gap (10) is adjustable.

5. An apparatus according to claim 1, wherein the first conveyor (7) comprises a third guide roller (15) with an adjustable position, which third guide roller (15) is arranged downstream of the document guiding path delivery gap (11), the direction of the document delivery being dependent on the adjusted position of the third guide roller (15).

6. An apparatus according to claim 1, wherein the first conveyor (7) is the upper conveyor and the second conveyor (8) is the lower conveyor.

7. An apparatus according to claim 1, wherein the guide rollers (13, 14, 15) are bearing-mounted in lever arms (16, 17, 18) provided with slotted holes **(16*a*, 16*b*, 16*c*), the lever arms (16, 17, 18) being attached to a fixed frame portion (22) via a bolt connection (19, 20, 21) with the aid of said slotted holes (16*a*, 16*b*, 16*c*)**.

* * * * *